US009099254B2

(12) United States Patent
Villain

(10) Patent No.: US 9,099,254 B2
(45) Date of Patent: Aug. 4, 2015

(54) ENHANCED CONTROL DEVICE WITH DRUM AND MULTIPLE SWITCHING CHANNELS

(71) Applicant: C&K Components S.A.S., Dole (FR)

(72) Inventor: Jean-Christophe Villain, Dole (FR)

(73) Assignee: C&K Components S.A.S., Dole (FR)

( * ) Notice: Subject to any disclaimer, the term of this patent is extended or adjusted under 35 U.S.C. 154(b) by 63 days.

(21) Appl. No.: 14/082,267

(22) Filed: Nov. 18, 2013

(65) Prior Publication Data

US 2014/0138220 A1 May 22, 2014

(30) Foreign Application Priority Data

Nov. 19, 2012 (FR) ..... 12 60943

(51) Int. Cl.

| | |
|---|---|
| ***H01H 9/00*** | (2006.01) |
| ***H01H 19/62*** | (2006.01) |
| ***H01H 27/00*** | (2006.01) |
| ***H01H 3/00*** | (2006.01) |
| ***H01H 19/00*** | (2006.01) |
| ***H01H 25/00*** | (2006.01) |
| *H01H 25/04* | (2006.01) |
| *H01H 19/14* | (2006.01) |

(52) U.S. Cl.

CPC ..... *H01H 3/00* (2013.01); *H01H 19/005* (2013.01); *H01H 25/008* (2013.01); *H01H 9/00* (2013.01); *H01H 25/04* (2013.01); *H01H 2019/006* (2013.01); *H01H 2019/146* (2013.01)

(58) Field of Classification Search

CPC ..... H01H 9/00; H01H 19/62; H01H 27/00; H01H 1/00; H01H 1/12; H01H 1/16; H01H 1/2041; H01H 3/00; H01H 3/02; H01H 3/22; H01H 3/26; H01H 3/32; H01H 3/40; H01H 3/42; H01H 3/54; H01H 5/00; H01H 5/04; H01H 13/00; H01H 13/20; H01H 13/26; H01H 19/005; H01H 19/28; H01H 19/60; H01H 2003/00; H01H 2003/02; H01H 2003/26; H01H 2009/0088; H01H 2009/0094; H01H 2013/005; H01H 2019/00; H01H 2205/004; H01H 2221/00; H01H 2221/01; H01H 2221/018; H01H 2221/024

USPC ..... 200/17 R

See application file for complete search history.

(56) References Cited

U.S. PATENT DOCUMENTS

| | | | | |
|---|---|---|---|---|
| 5,898,147 | A | 4/1999 | Domzalski et al. | |
| 6,194,673 | B1 | 2/2001 | Sato et al. | |
| 6,211,474 | B1 * | 4/2001 | Takahashi | 200/18 |
| 6,271,488 | B1 * | 8/2001 | Sasaki | 200/4 |
| 6,388,212 | B1 * | 5/2002 | Ishihara et al. | 200/18 |

FOREIGN PATENT DOCUMENTS

FR 2792486 A1 10/2000

* cited by examiner

*Primary Examiner* — Edwin A. Leon
*Assistant Examiner* — Anthony R. Jimenez
(74) *Attorney, Agent, or Firm* — Fox Rothschild LLP

(57) ABSTRACT

A control device for generating electrical signals. The control device includes a bottom support, a first, a second, and a third fixed contacts, a first, a second, and a third moving contacts, each of which is elastically deformable. The control device also includes an intermediate control cradle thank includes first, second and third actuating pawls. The control device is suitable for occupying an inactive position in which at least one first, one second and one third bearing points of the intermediate cradle are in abutment, vertically upwards, each against an associated surface portion facing the bottom support, and a single top control member in the form of a drum.

9 Claims, 13 Drawing Sheets

ENHANCED CONTROL DEVICE WITH DRUM AND MULTIPLE SWITCHING CHANNELS

CROSS REFERENCE TO RELATED APPLICATION

This application claims the priority benefit of France Patent Application No. 1260943 filed Nov. 19, 2012, the content of which is hereby incorporated by reference in its entirety.

BACKGROUND

The present disclosure relates to a control device generating electrical signals for the control of an electronic appliance. Such a device is also called switch with multiple electrical switching channels. More particularly, the present disclosure relates to a control device with multiple switching channels, with tactile effect.

Recent developments and the rapid evolution of telecommunication means, such as portable radiotelephones, laptop computers and other devices that make it possible, for example, to play by accurately moving a cursor on a screen, and, for example, on the steering wheel of a motor vehicle, require the availability of electromechanical components of reduced dimensions and, in particular in the areas mentioned previously, the possibility to scan menus, move a symbol on a screen and, more generally, combine in a single component a plurality of electrical switching functions.

It is desirable to have a device that uses a single control member that makes it possible, on the one hand, to generate pulses or electrical signals repeated at high frequency and, on the other hand, to generate unitary signals, for example selection signals, and do so with a user-friendliness that is perfectly suited to this type of operation, that is to say which enables the user to easily and rapidly produce the repeated pulses, for example in order to perform a rapid scan of a menu or of a list, then to produce selection signals.

It is notably desirable for such a control member with multiple switching channels to be able to be manipulated with the thumb by being located on the front main face of the telephone notably comprising the keypad, or on one of the two main side edges of the telephone casing, or under the main face of the telephone. The same applies when such a control member is incorporated in the rim of a steering wheel of a motor vehicle, the manipulation having to be able to be performed reliably and blindly by the driver.

The need for a control device that is compact and of small dimensions that makes it possible to move a cursor on a screen, and/or to scroll menus (scanning), also called "navigator", is becoming increasingly important for the control of appliances that are offering more and more functions and services notably involving options offered on one or more screens, in a manner similar to the use of a laptop computer.

It is also desirable to be able to have at least one selection function on which the user presses to select an option corresponding to the position reached by the cursor on the screen through the manipulation of a control member, notably in the form of a rotating drum. Furthermore, it is desirable to be able to have a very efficient navigator that makes it possible in particular to move around both with speed and accuracy.

Moreover, the tactile sensation transmitted by the device to the user of the navigator is a very important parameter for its efficiency and its user-friendliness. The sensitivity of the touch of the user is such that it enables him or her to perceive very fine, discrete or continuous variations, and it is thus possible to transmit to the finger or to the hand of the user a very complex "message". The finger is thus a giver of commands (or sender) for moving the cursor on the screen and/or for selecting a position of the cursor, and it is also a sensor (or receiver) which "blindly" perceives tactile information in return via the actuator or control member of the control device, without therefore the user having to look at the screen and/or in addition to his or her visual perceptions.

It is thus desirable to provide the user with tactile sensations which are produced directly in response to the movement of the finger on the actuator, that is to say in its function as sender. In the case of a movement or scanning, such tactile information or sensations are, for example, mechanical pulses or "clicks" corresponding to each electrical signal or pulse produced by the navigator and intended for the electronic signal or data processing circuits of the appliance, or corresponding to series of pulses.

Other mechanical pulses or "clicks" correspond to the electrical pulses supplied to the electronic circuits upon a manual selection (select) action, for example when a target has been reached on the screen. Such a control device must now be able to be of the so-called five switching channels type, that is to say having a first and a second switching channels corresponding to the rotation of the control drum in one or other of the two directions of rotation, for example for vertical movements on a screen, a third and a fourth switching channels by pressing on the left or right end of the drum to move in corresponding directions on the screen, then a fifth so-called selection channel, when a target area has been reached, by pressing at the centre of the control drum.

It is necessary to be able to have a tactile sensation upon the generation of the signals associated with the third, fourth and fifth switching channels. Moreover, a significant enhancement of the reliability of this type of control device or navigator is required by the market, notably with regard to the dust-tightness of the electrical contact areas, which has led to this requirement being taken into account from the product design phase.

To this end, a control device has already been proposed that is of the type comprising a rotating horizontal shaft that can be driven in rotation, in both directions, by a manually driven drum borne by the shaft to which it is linked in rotation, of the type in which the shaft is linked in rotation to at least one rotating member belonging to a generator of control signals, or pulses, for an electronic appliance, to generate signals according to a first or a second switching channels notably to control movements of a cursor on a display screen of the appliance, and of the type in which the shaft is mounted to move vertically and pivot in both directions about a transversal horizontal axis orthogonal to the longitudinal axis of the shaft to selectively provoke the triggering: (1) of a triggering member belonging to a third switching channel when a distinct force is applied in the vicinity of one of the two longitudinal ends of the drum; (2) of a triggering member belonging to a fourth switching channel when a distinct force is applied in the vicinity of the other of the two longitudinal ends of the drum; and (3) of a triggering member belonging to a fifth switching channel when a (selection/select) force of vertical orientation is applied substantially at the centre (at mid-length) of the drum.

Design examples of such a device are, for example, described in France Patent Publication FR 2792486, the content of which is hereby incorporated by reference. In this document, three triggering members of bistable type are used, each making it possible to generate a tactile sensation when it is actuated to generate an associated signal. Such a design has the drawback of exhibiting the risk of simultaneous production of several "clicks", that is to say several tactile sensations corresponding to the simultaneous or quasi-simultaneous actuation of two bistable triggering members, or moving contacts.

In order to prevent this phenomenon which is detrimental to the good user-friendliness of the control device, a hinge ball joint is used for the cradle supporting the rotating cylindrical drum, so as to mechanically "separate" the different "pivotings" of the support cradle. However, this solution is not satisfactory because it culminates in very poor user-friendliness when actuating in "selection" or "select" mode because it requires the user to apply his or her force to the drum in an almost pinpoint manner at a "central" point at axial mid-length of the drum, failing which the user accidentally generates "left" or "right" signals, instead of a "select" signal.

The present invention aims to propose a control device that uses only a single bistable control member supplying a tactile sensation reliably and unequivocally.

SUMMARY

This disclosure is not limited to the particular systems, methodologies or protocols described, as these may vary. The terminology used in this description is for the purpose of describing the particular versions or embodiments only, and is not intended to limit the scope.

As used in this document, the singular forms "a," "an," and "the" include plural reference unless the context clearly dictates otherwise. Unless defined otherwise, all technical and scientific terms used herein have the same meanings as commonly understood by one of ordinary skill in the art. All publications mentioned in this document are incorporated by reference. All sizes recited in this document are by way of example only, and the invention is not limited to structures having the specific sizes or dimension recited below. As used herein, the term "comprising" means "including, but not limited to."

The present disclosure relates to a device that makes it possible, by means of a single control member (also called actuating member), to perform distinct electrical switching operations in order, for example, to control a function of an electronic appliance following choices made by selection in a menu or a list on a display screen.

To this end, the invention proposes a control device generating electrical signals of the type including: a bottom support in the general form of a horizontal plate; a first, a second, and a third fixed contacts arranged in a triangle on the top face of the bottom support; a first, a second, and a third moving contacts, each of which is elastically deformable and can cooperate with the first, the second, and the third fixed contacts respectively to generate a first, a second, and a third corresponding electrical signals; an intermediate control cradle which: i) is arranged above the fixed bottom support, relative to which it is movably mounted; ii) comprises a first, a second and a third actuating pawls, each of which can act in a pinpoint manner on the first, the second, and the third moving contacts respectively; iii) is suitable for occupying an inactive position, high relative to the bottom support, in which at least one first, one second and one third bearing points of the intermediate cradle are in abutment, vertically upwards, each against an associated surface portion facing the bottom support, among which, seen from above the device: a) the first bearing point is arranged in the vicinity of the point of action of the first pawl on the first moving contact; b) the second bearing point is arranged in the vicinity of the point of action of the second pawl on the second moving contact; and c) the third bearing point is offset transversely, towards the third moving contact, relative to a line passing through the first and second bearing points.

The control device further includes a single top control member of generally cylindrical form which is mounted to rotate in both directions relative to the intermediate cradle, about a longitudinal axis of rotation, of substantially horizontal orientation, to rotate a generator of electrical signals representative of the rotation of the control member, and which makes it possible, by acting via the intermediate cradle, to actuate the first, second, and third moving contacts.

Additionally, in the control device: the first and the second fixed contacts are aligned longitudinally in a direction which, seen from above, is parallel to the axis of rotation of the control member and which, seen from above, is offset transversely on one side of the axis of rotation; the third fixed contact is, seen from above, offset transversely on the other side of the axis of rotation of the control member; the intermediate cradle is mounted to pivot relative to the bottom support; about a first pivoting axis passing through the second bearing point and through the point of action of the first pawl on the first moving contact, in order to selectively actuate the first moving contact, upon an action on a first axial end part of the control member; and about a second pivoting axis passing through the first bearing point and through the point of action of the second pawl on the second moving contact, in order to selectively actuate the second moving contact, upon an action on the second axial end part of the control member.

According to other features of the invention: the elastic stiffness of the first and second moving contacts is less than that of the third moving contact, and, after elastic deformation of the first and second moving contacts, the intermediate cradle is mounted to pivot relative to the bottom support about a third pivoting axis, parallel to the axis of rotation of the control member, in order to then actuate the third moving contact upon an action on the central axial part of the control member; the sum of the elastic stiffnesses of the first and second moving contacts is less than the elastic stiffness of the third moving contact; the third moving contact is a bistable dome-shaped element with tactile effect; the third fixed contact and the third moving contact are incorporated in a bistable electrical switch with tactile effect which comprises an actuating pushbutton upon which the third pawl of the intermediate cradle acts; the intermediate cradle is returned elastically upwards in the inactive position by the three elastically deformable moving contacts; the third bearing point of the cradle comprises a pair of third bearing points which are in abutment, vertically upwards, each against an associated surface portion facing the bottom support and which, seen from above the control device, are offset transversely, towards the third moving contact, relative to a straight line passing through the first and second bearing points; each bearing point is arranged at the free end of an associated tab which extends vertically downwards from the intermediate cradle; and the device exhibits a general design symmetry relative to a vertical and transversal plane of symmetry orthogonal to the axis of rotation of the control member and passing through the point of the third pawl which acts on the third moving contact.

BRIEF DESCRIPTION OF THE DRAWINGS

Other features and advantages of the invention will become apparent on reading the following detailed description, for an understanding of which reference should be made to the appended drawings in which.

DETAILED DESCRIPTION

In the following description, components or elements that are identical, analogous or similar will be designated by the same references. To assist in understanding the description and the claims, the terms horizontal, vertical, top, bottom, high, low will be used with reference to the vertical, longitudinal and transversal directions indicated in the figures by the L, V, T trihedron, but without reference to the earth's gravity.

Figure 1:
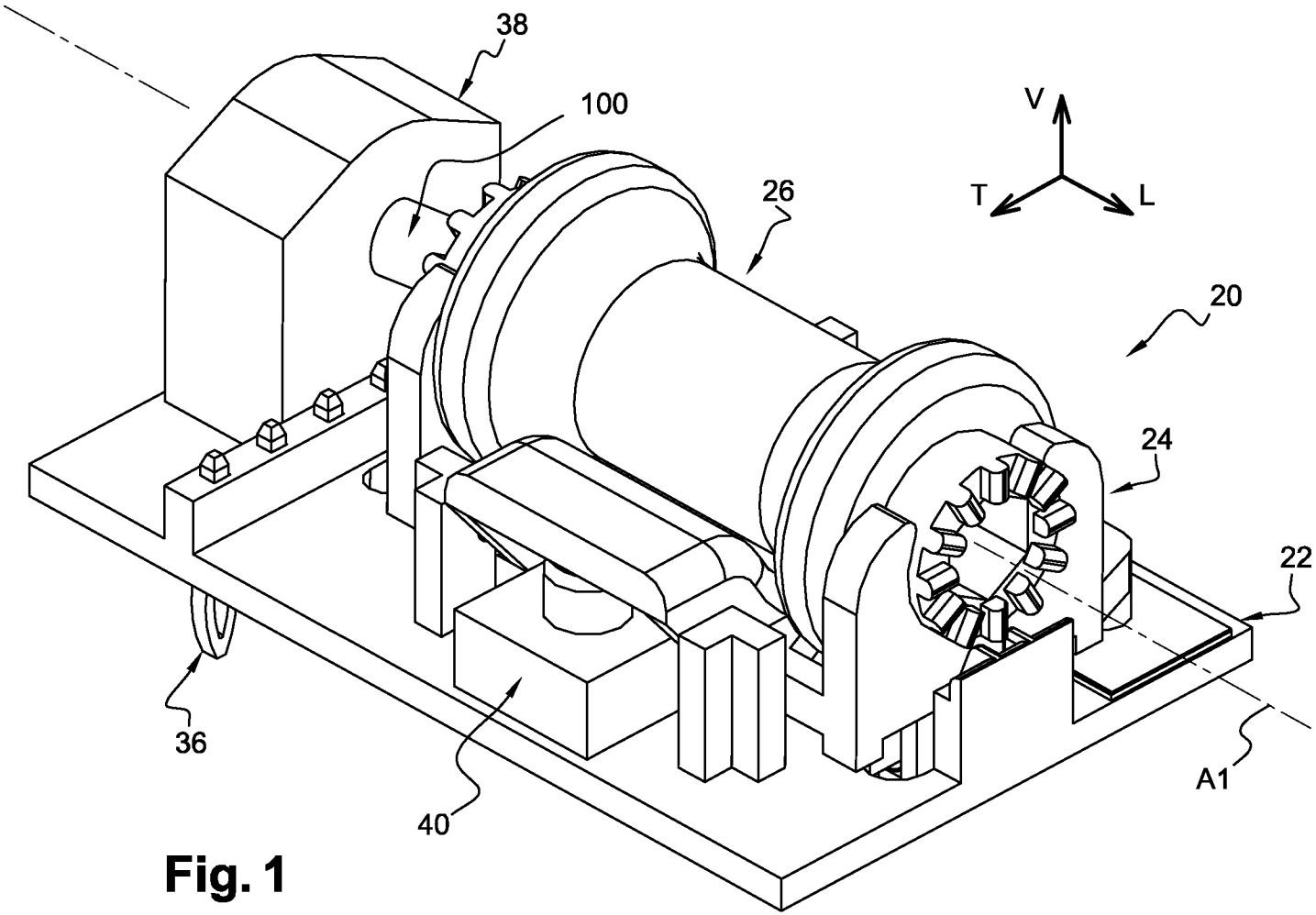
FIG. 1 is a perspective view of an exemplary embodiment of a control device according to the invention.
Figure 2:
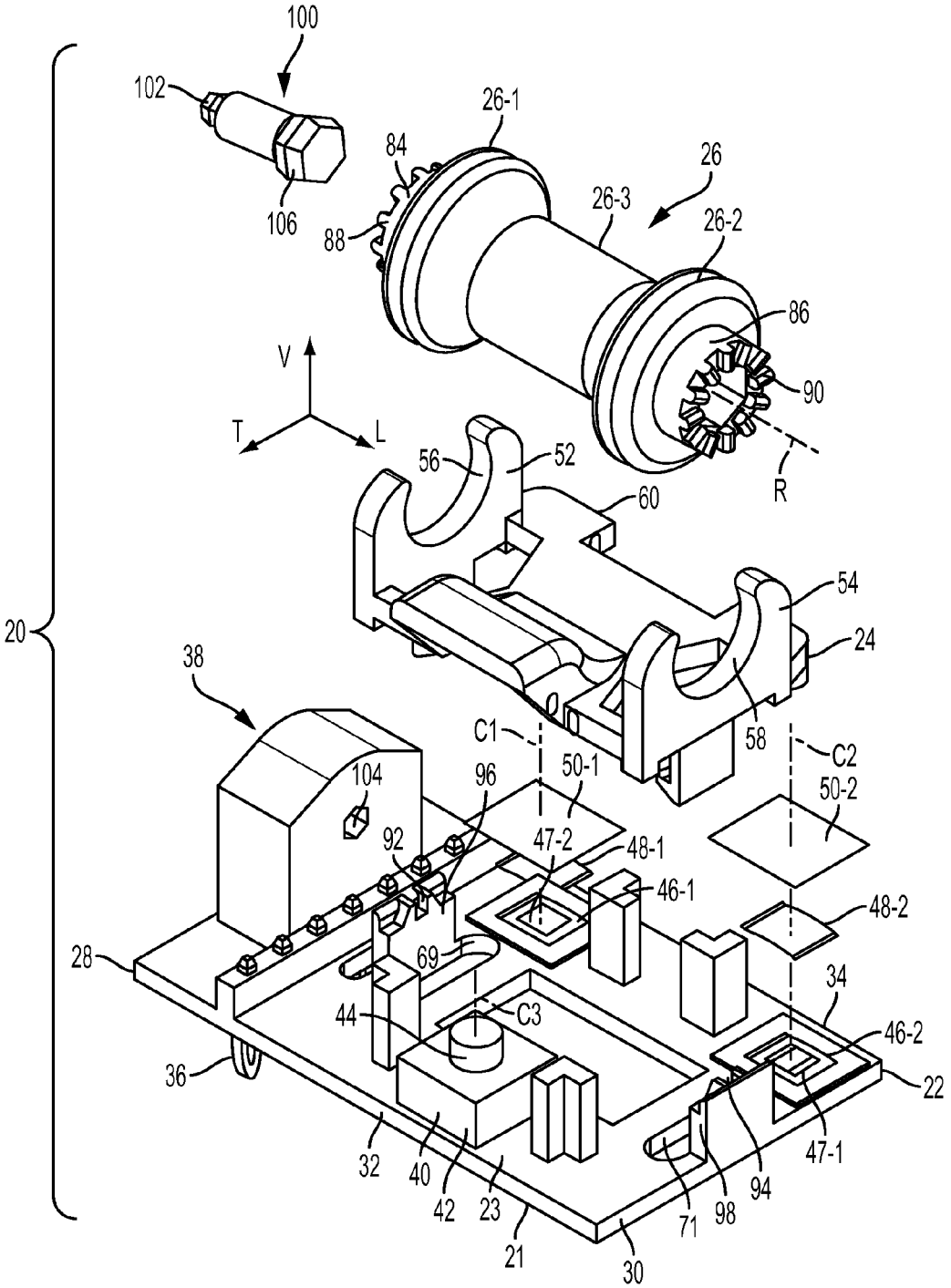
FIG. 2 is an exploded perspective view of the main components of the device of FIG. 1.

The control device 20 here takes the form of a unitary component that can be integrated in an electronic appliance, by different known mounting and electrical connection means. FIGS. 1 and 2 notably show the control device 20 according to the invention which includes, arranged vertically from bottom to top, three main components: a bottom support 22 in the general form of a horizontal plate; an intermediate control cradle 24; and a single top control member 26 in the form of a drum.

The bottom support plate 22 can be a moulded plate of plastic material and it is, for example, overmoulded around a series of electrical connection terminals, or pins, 36, of which there are eight here, which notably protrude vertically under the bottom face 21 of the plate 22, to form a male electrical connector for electrically connecting the device 20.

The plate 22 can be delimited by its two horizontal and parallel bottom 21 and top 23 faces. The plate 22 can be delimited horizontally by two left 28 and right 30 transversal edges, and by two front 32 and rear 34 longitudinal edges. All the other components and elements of the device 20 may be organized here, fixed and/or added onto the top face 23.

In the vicinity of the left transversal edge 28, there is a rotating generator of electrical signals 38 that can, as is known, be rotated in both directions to generate electrical signals representative of the direction of rotation and of the angle of rotation of the signal generator. The signals are generated according to a coding pitch, for example corresponding here to twelve signals per revolution. Such a component is, for example, illustrated in U.S. Pat. No. 6,194,673, the content of which is hereby incorporated by reference.

The generator 38 can be electrically linked to two of the pins 36. In its central part and in the vicinity of the front longitudinal edge 32, the top face 23 can bear a bistable electrical switch with tactile effect 40 which is an electromechanical component of known general design such as, for example, of the type described and represented in U.S. Pat. No. 5,898,147, the content of which is hereby incorporated by reference.

As is known, such a bistable switch (also called "pushbutton tact switch") can house, in its bottom housing 42, at least one fixed contact (see 49-3 in FIG. 3)—or one pair of fixed contacts—and one moving contact that can be an elastically deformable member, for example in the form of a bistable dome, and that can change state abruptly upon an action on this triggering member via, for example, the top vertical pushbutton 44 along an actuating or triggering axis C3 of overall vertical orientation. As shown, the pushbutton can protrude vertically upwards, out of the housing 42.

The switch 40, in addition to its function of generating electrical signals when it switches from its normally open state to its closed actuated state, can provide a tactile sensation of change of state and of triggering which is transmitted mechanically via the pushbutton 44. The electrical switch 40 is electrically connected to two of the connection pins 36.

In the vicinity of its rear longitudinal edge 34, the top face 23 can delimit two recesses 46-1 and 46-2 that are open vertically upwards and in the bottom of each of which can be arranged at a first fixed electrical contact 47-1 and a second fixed electrical contact 47-2. Each recess 46-1, 46-2 is designed to house associated moving contacts 48-1, 48-2 which is produced here in the form of an elastically deformable blade and whose bottom face is conductive.

In its non-deformed rest state, each moving contact blade 48-1, 48-2 bulges upwards and does not cooperate with the associated first and second fixed contacts 47-1 and 47-2. Each elastically deformable moving contact blade 48-1, 48-2 can be deformed in response to an action upon it along a substantially vertical actuation and triggering axis—C1, C2 respectively—to cooperate with the associated fixed contact or contacts to generate an associated electrical signal.

The figures also show a top sealing film 50-1, 50-2 that can seal each recess 46-1, 46-2 tightly to protect the first and second fixed contacts 47-1 and 47-2 and the associated moving contacts 48-1 and 48-2. Thus, the electrical signal generators or similar devices of the control device according to the invention are suitable for producing signals on five switching channels—as mentioned previously—are all here borne by the bottom support plate 22 and are arranged on its top face.

The actuation of the different electrical signal generating means borne by the bottom support plate 22 can be performed by means of the rotating control drum 26 that, within the meaning of the invention, is the single top control member that makes it possible, when the user manipulates it, to actuate and control the rotating signal generator 38 selectively and directly, and to actuate and control the elastically deformable electrical contacts selectively along the axes C1, C2 and C3 via the intermediate cradle 24.

The intermediate cradle 24, or intermediate deck, can be a moulded part of plastic material in the general form of a horizontal plate and which includes, at its two opposite left and right longitudinal ends, two upwardly protruding transversal and vertical wings 52, 54, each of which includes a concave cylindrical recess 56, 58 that can be open towards the top and is suitable for receiving, with rotation, a complementary rotational guiding part of the control drum or rotor 26.

Under its bottom face, and in the vicinity of its rear longitudinal edge 60, the intermediate cradle 24 includes two vertical actuating pawls 62-1 and 62-2—the bottom free end of which is in the form of a spherical dome—which are positioned longitudinally in such a way as to each define a direction of actuation C1, C2 that is globally aligned with the direction C1, C2 of actuation of the first and second moving contacts 48-1 and 48-2.

The intermediate cradle 24 includes a third actuating pawl 66 which extends vertically downwards from the bottom face of the intermediate cradle 24 and whose bottom end face is in the form of a spherical dome to define a third actuation axis C3 that is vertical and that is arranged in a triangle relative to the axes C1 and C2 and is substantially aligned with the axis C3 of actuation of the pushbutton 44 of the switch 40 whose housing houses the third elastically deformable moving contact.

Thus, the bottom three actuating pawls 62-1, 62-2 and 66 can constitute a tripod, which makes it possible, on the one hand, to selectively actuate the moving contacts and which, on the other hand, enables the intermediate cradle to "rest" vertically bearing on the three elastically deformable contacts without deforming them when the intermediate actuating cradle is in its so-called "inactive" high position.

In the vicinity of its opposing transversal edges and substantially in line with the lateral wings 52 and 54, the intermediate cradle includes two bottom tabs 68 and 70, each of which extends vertically in a transversal plane and downwards. Each tab 68, 70 is in the general form of an L-shaped hook and it thus includes a bottom horizontal face 72, 74.

Figure 3A:
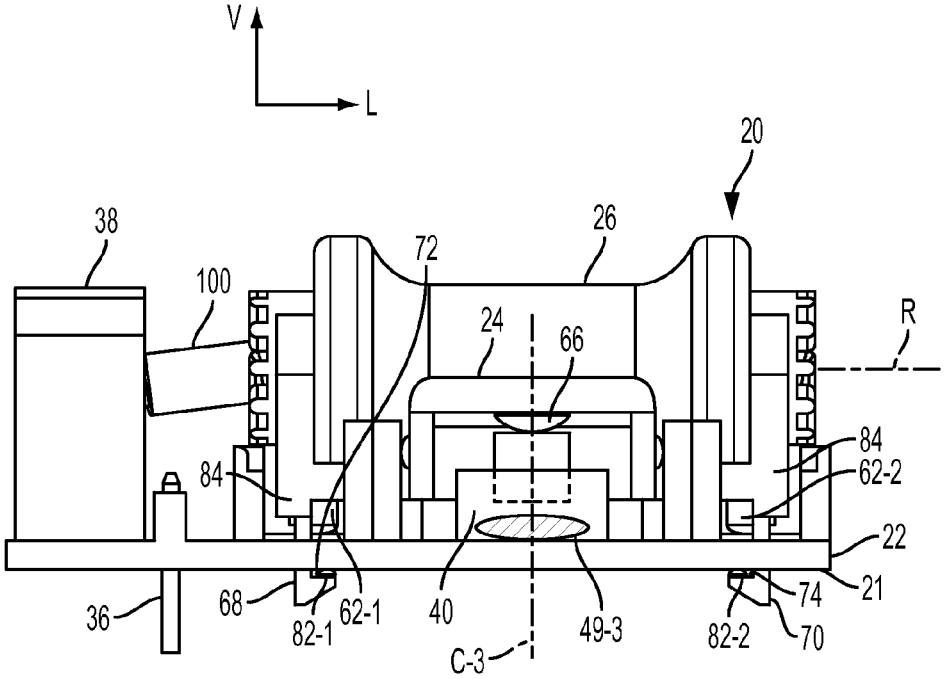
FIGS. 3A and 3B are two lateral side views of the control device of FIG. 1.
Figure 3B:
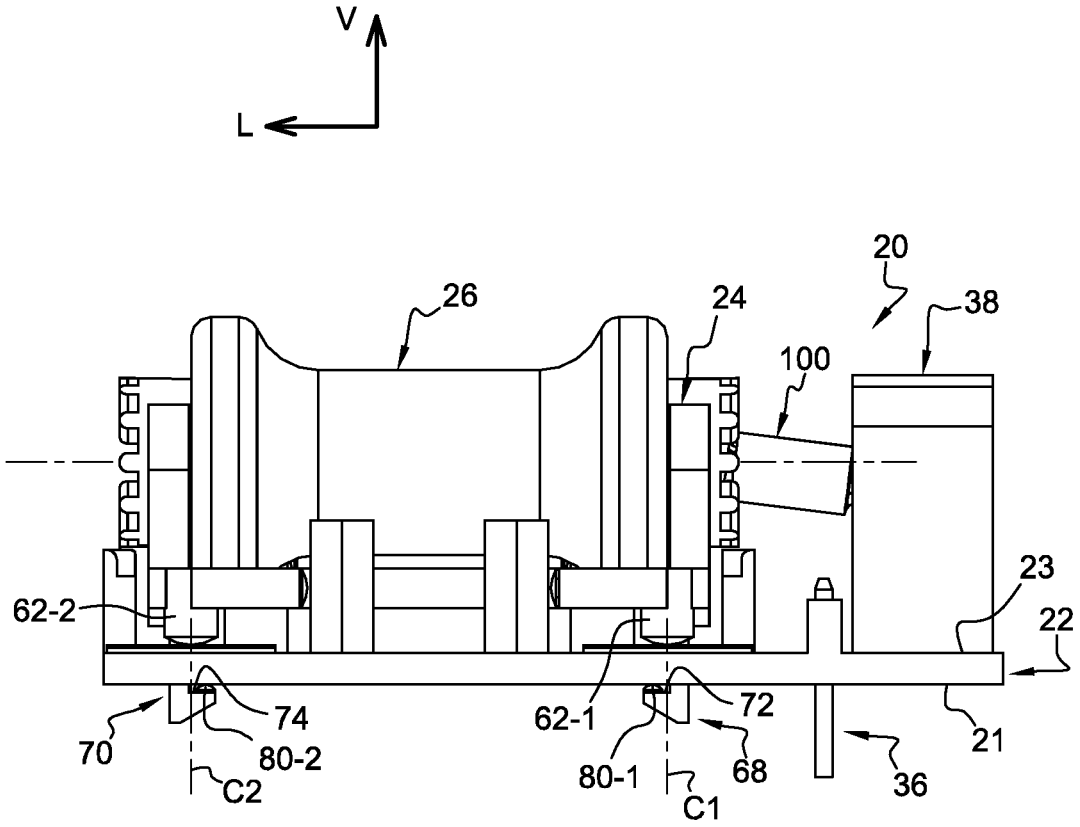
Figure 4:
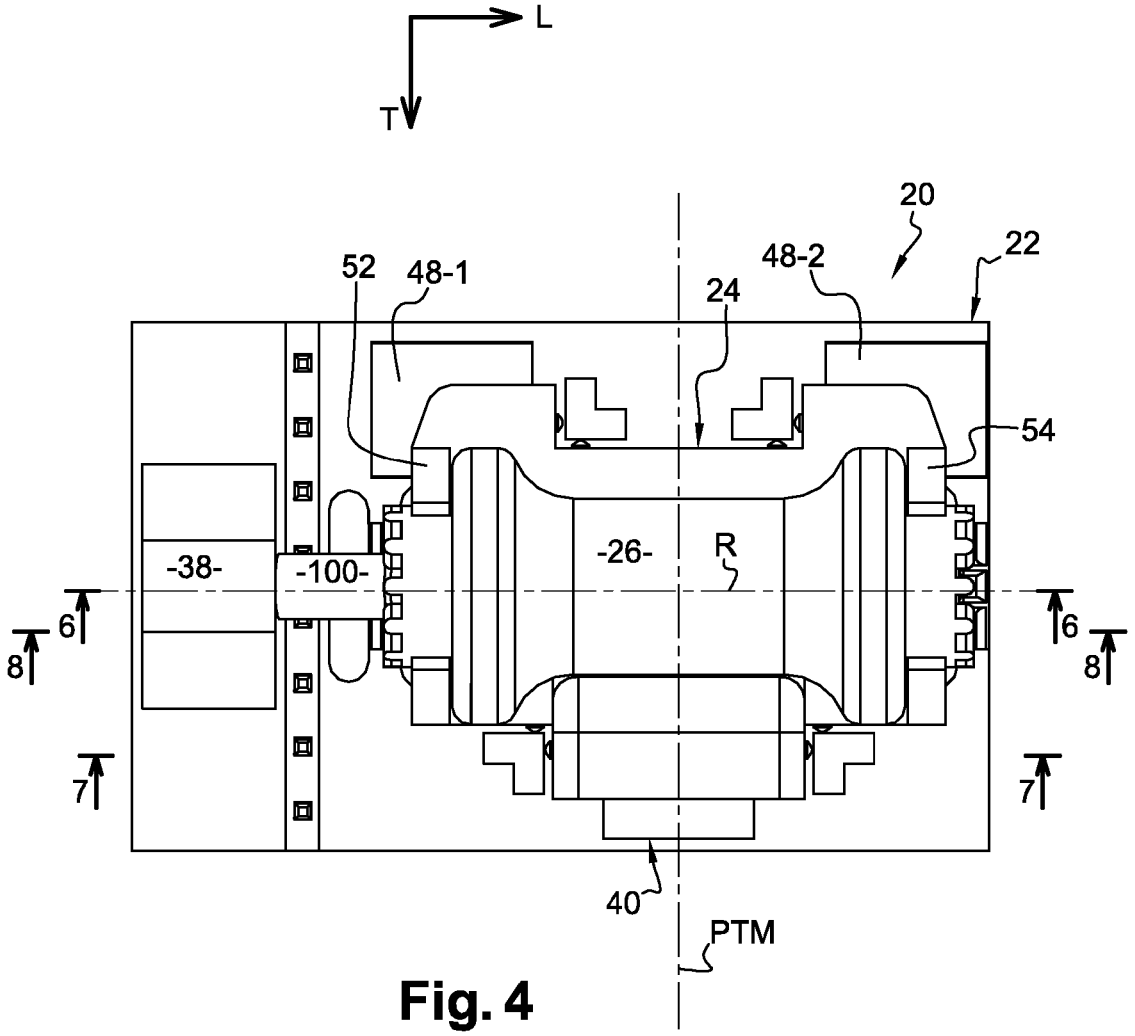
FIG. 4 is a plan view of the control device of FIG. 1.
Figure 5:
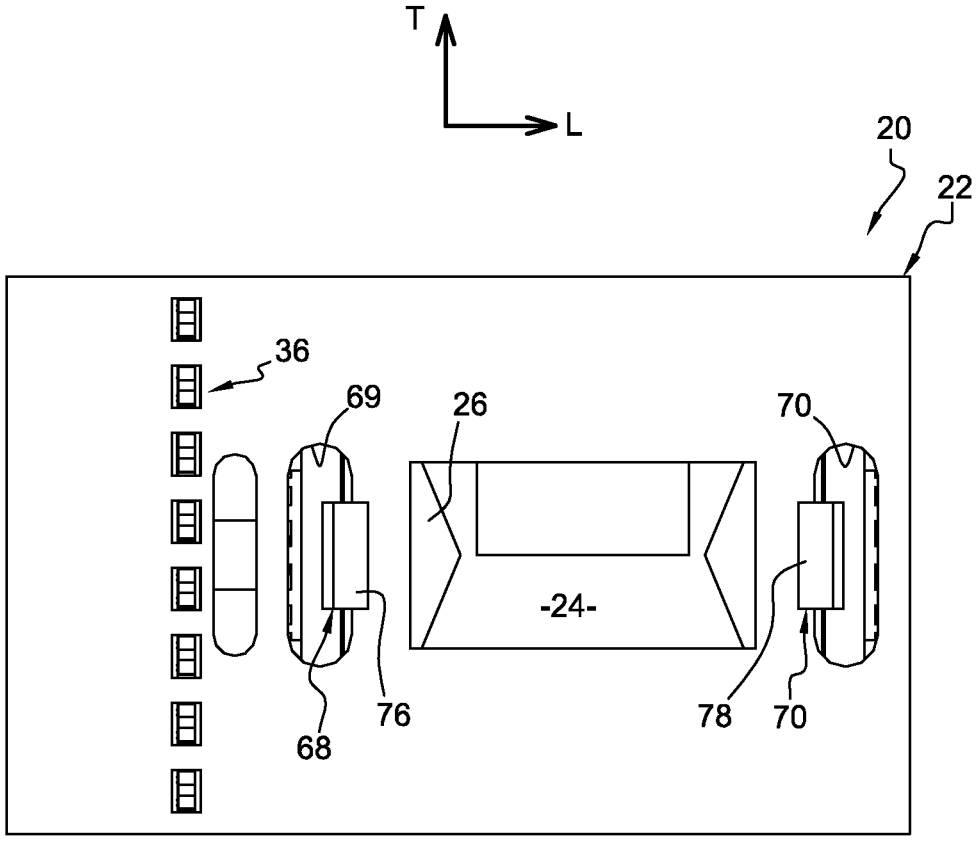
FIG. 5 is a view from below of the control device of FIG. 1.

Each tab 68 can also include a chamfer-forming inclined face 76, 78 allowing for the introduction and elastic fitting of the tabs 68 and 70, through associated openings 69 and 71 formed in the bottom plate 22, so that—in the assembled position and as illustrated for example in FIGS. 3A and 3B—the upwardly oriented bottom horizontal faces 72 and 74 extend facing corresponding portions of the bottom face 21 of the plate 22. The top face 72 of the tab 68 includes two convex bulging studs in the form of a spherical dome that are aligned transversely. The face 72 thus includes a rear bearing stud 80-1 that defines a bearing and pivoting point S1 suitable for cooperating with the bottom face 21 of the plate 22. It also includes a front stud 82-1 that defines a bearing point S3A.

Similarly, the top face 74 of the tab 70 includes two convex bulging studs in the form of a spherical dome that are aligned transversely. The face 74 thus includes another rear bearing stud 82-1 that defines a bearing and pivoting point S2 suitable for cooperating with the bottom face 21 of the plate 22. The face 74 also includes another front stud 82-2 that defines another bearing point S3B.

As a nonlimiting example, in the assembled position of the intermediate cradle 24 on the bottom plate 22, the three elastically deformable moving contacts serve as return springs and springs for taking up play, so that the three vertical actuating pawls 62-1, 62-2 and 66 bear, without play, on the elastically deformable contacts and the four bearing points S1, S2, S3A and S3B of the tabs 68 and 70 bear without play against the facing portions of the bottom face 21 of the plate 22.

The intermediate cradle 24 can also include four bottom feet 84 arranged substantially at its four opposite corners, each of which can bear against a facing portion of the top face 23 of the plate 22 to delimit a maximum travel of vertical movement of the intermediate cradle 24 relative to the bottom plate 22. In the inactive high position, and as can be seen for example in FIGS. 3A and 3B, the bottom faces of the feet 84 extend clearly above the top face 23.

The single control drum, or rotor, 26 is a part of generally cylindrical form and with a longitudinal axis of rotation R that includes a cylindrical central part 26-3 with rectilinear generatrix that extends longitudinally and axially between the two left 26-1 and right 26-2 axial end parts, each of which is of cylindrical form, but with a larger diameter than the central part 26-3. As an example, the total axial length of the drum is, for example, of the order of 25 mm with a diameter of its central part of 9 mm and a diameter of 14 mm for its axial end parts.

Beyond these two axial end parts 26-1, 26-2, the drum 26 includes a rectilinear, cylindrical end piece 84, 86, each of which can be received by elastic fitting and be guided in rotation in the associated complementary recess 56, 58 of the intermediate cradle 24. Thus, the drum 26 is mounted to rotate freely, but is immobilized axially relative to the intermediate cradle 24.

Each end piece 84, 86 here includes a series of twelve radial snugs 88, 90 that are evenly distributed angularly and that protrude axially to the left and to the right respectively. As is known in this type of control device by means of a rotating drum, the snugs 88 and 90 are suitable for cooperating with complementary notches 92, 94 that are arranged at the top free end of tabs 96, 98 here produced by moulding as part of the bottom plate 22, from which they extend vertically upwards. The cooperation of the snugs 88 and 90 with the notches 92 and 94 makes it possible to provide a function of angular indexing and rotation braking of the drum 26 upon an action on one or other of the axial end parts 26-1 or 26-2.

Figure 6:
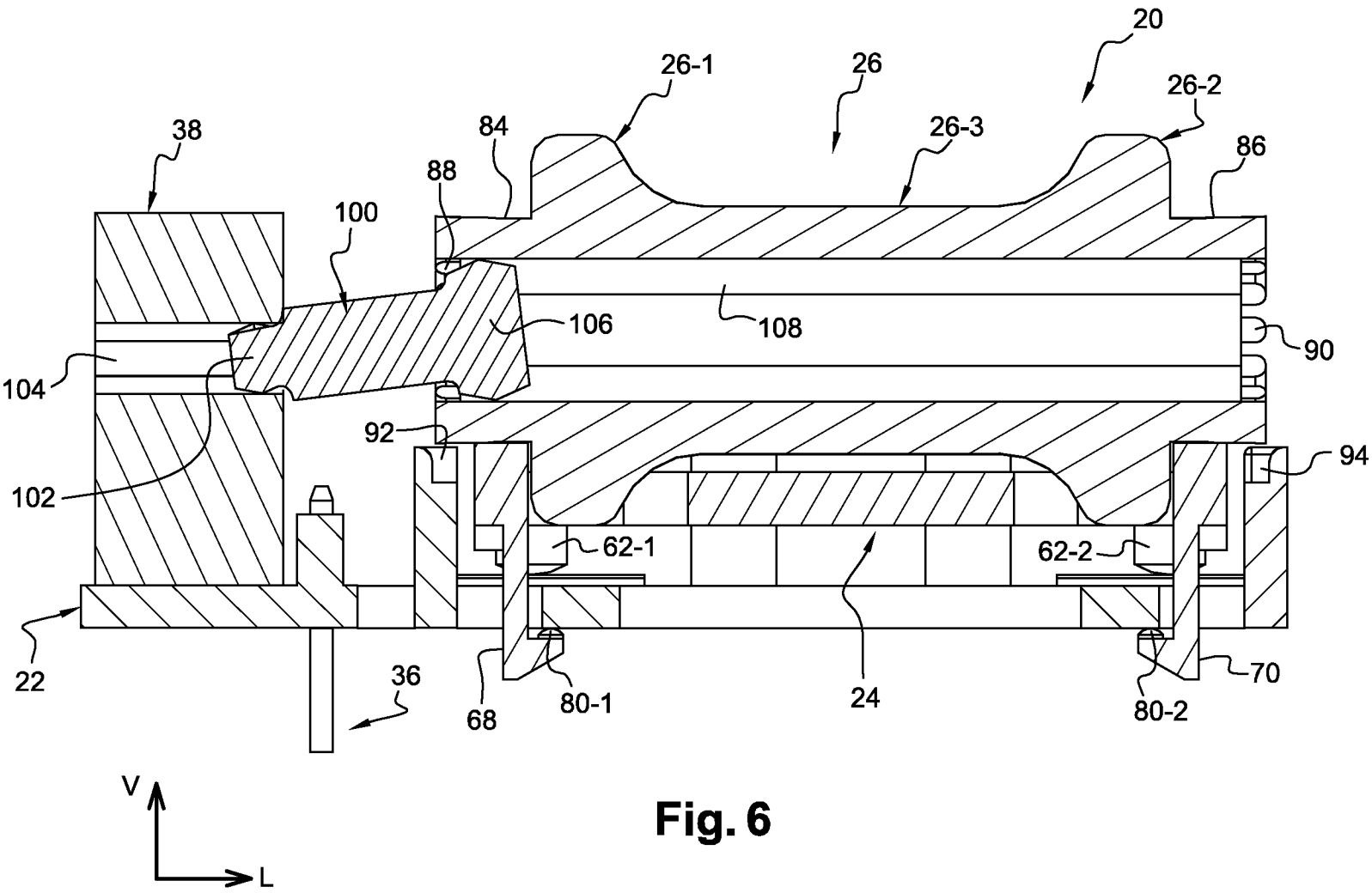
FIG. 6 is an axial cross-sectional view along the line 6-6 of FIG. 4.
Figure 7:
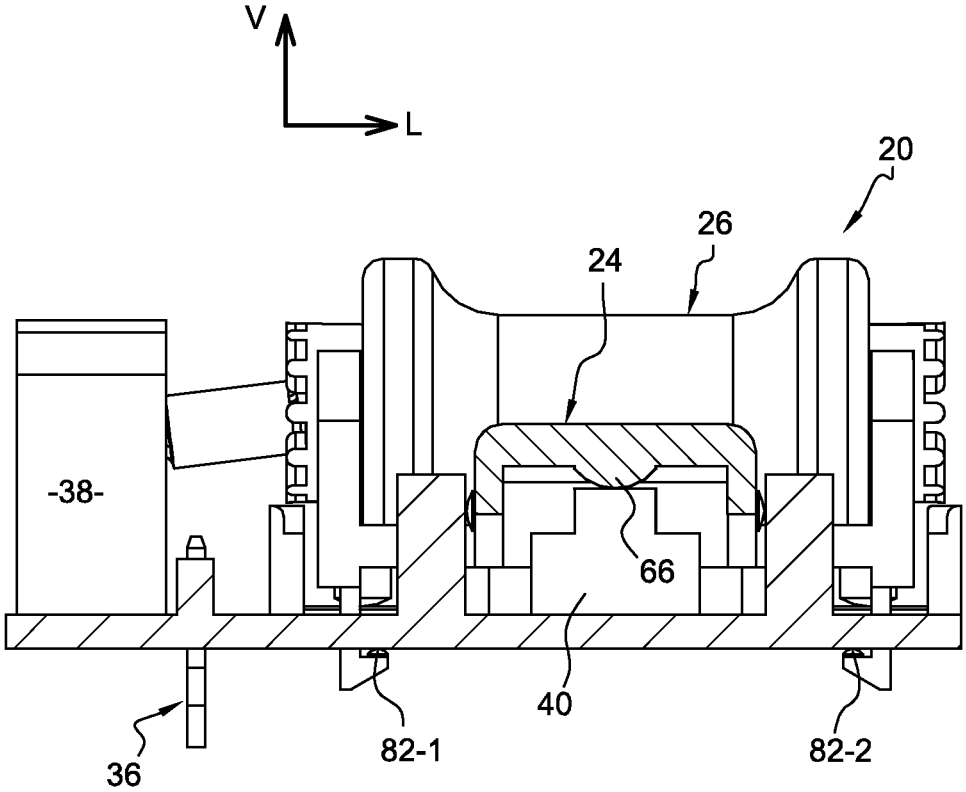
FIGS. 7 and 8 are axial cross-sectional views along the lines 7-7 and 8-8 of FIG. 4.
Figure 8:
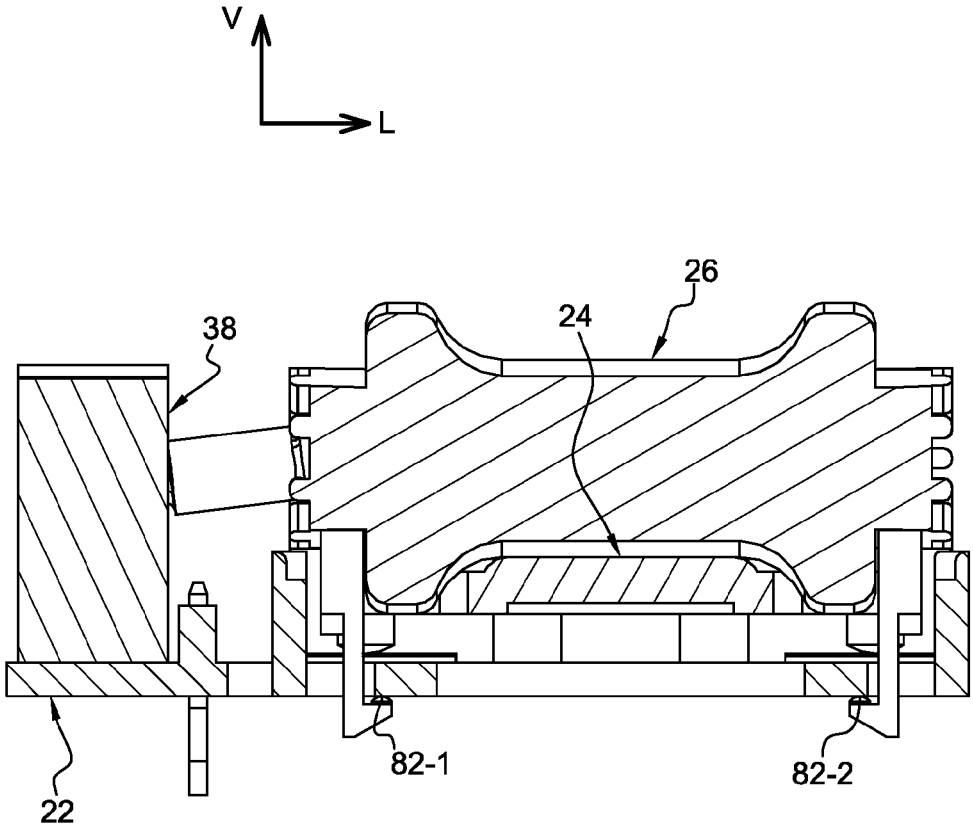
Figure 9:
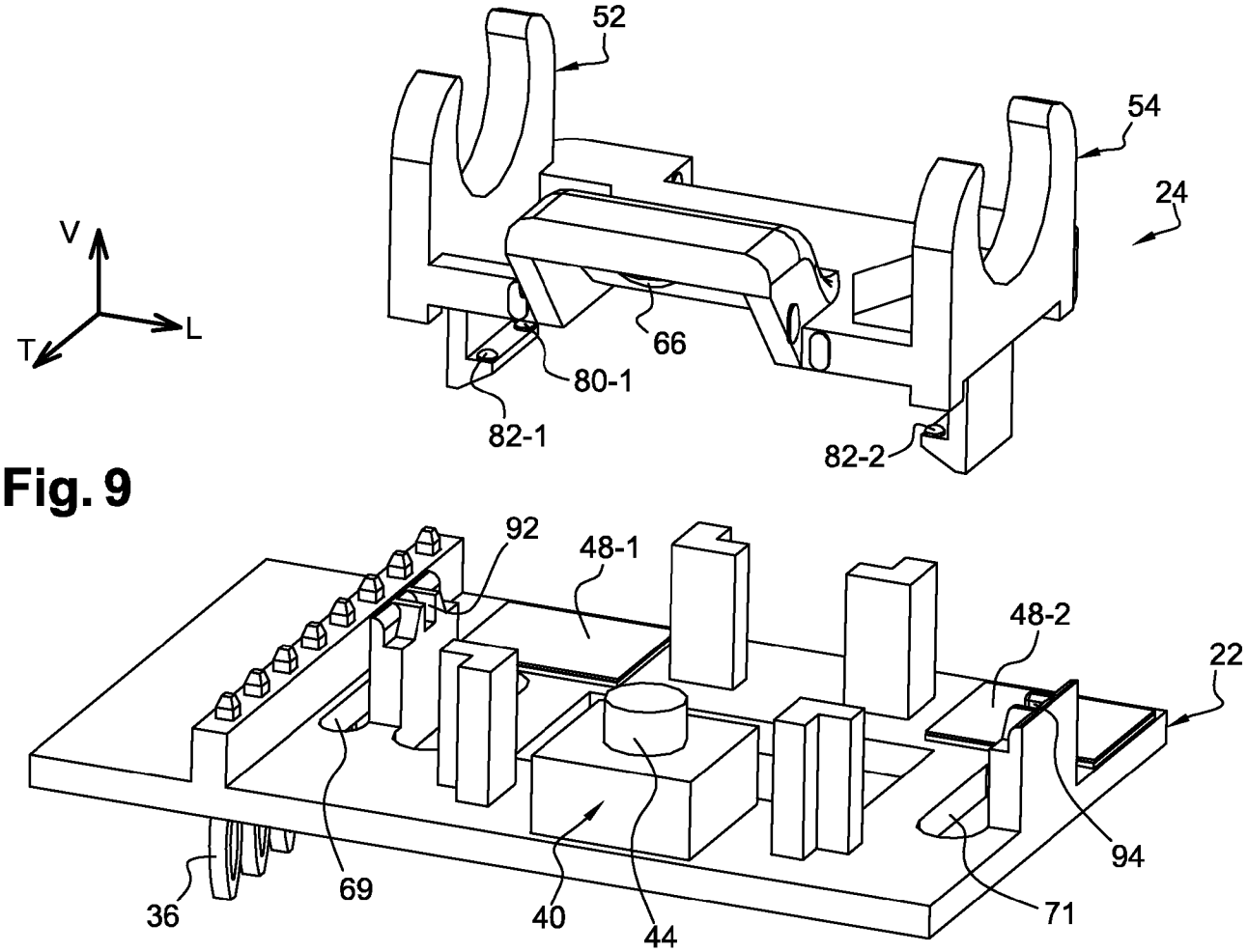
FIG. 9 is an exploded perspective view of two of the main components of the device of FIG. 1.

Finally, for the rotation in both directions of the rotating electrical signal generator 38 by the drum 26, the control device 20 can include a transmission shaft 100. As can be seen notably in FIGS. 2 and 6, the transmission shaft 100 includes a polygonal left axial end 102 that is received in a complementary recess 104 of the generator 38, and a polygonal right axial end 106 that is received in a complementary central axial recess 108 of the control drum 26. This design allows for an angular indexing of the rotational position of the drum 26 relative to the signal generator 38, as well as an adaptation of the tilt of the shaft 100 relative to the generator 38 and to the control drum 26 as a function of the movements of the control drum 26 relative to the bottom support plate 22, and therefore, relative to the generator 38.

An exemplary mode of operation of the control device 20 will now be described. When the user wants to provoke signals corresponding to the rotation in one or other direction of the control drum 26, all he or she needs to do is rotate it about its axis of rotation R, relative to the intermediate cradle 24, by driving it with one of his or her fingers and by acting for this purpose on the central part 26-3 of the drum 26. When the user wants, for example, to generate a select signal, he or she simply has to press on the central part 26-3 of the drum 26. Finally, when he or she wants to generate a distinct "left" or "right" signal, the user simply has to act on the corresponding axial end part 26-1 or 26-2 of the drum 26.

More specifically, reference will now be made to the diagrams of FIG. 12A to FIG. 14B. First of all, as shown in the figures, the design according to the invention here exhibits, as a preferred example, a general design symmetry relative to a median transversal plane, that is to say relative to a transversal and vertical plane passing through the actuation axis C3 and that is also orthogonal to the axis of rotation R. Seen from above, the two actuation axes C1 and C2 are aligned according to a horizontal axis A3 that is parallel to the axis of rotation R of the control drum 26 and that is offset transversely upwards (looking at the figures) relative to the axis R. The actuation axis C3, for its part, is offset relative to the axis of rotation R on the other side, that is to say downwards looking at the figures.

Figure 12A:
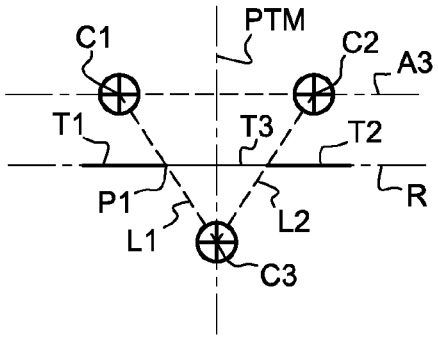
FIGS. 12A and 12B are two plan view diagrams illustrating the positions and particular geometrical arrangements of the different actuating, pivoting, and rotation axes of the different components of the control device.

As can be seen in FIG. 12A, the line L1 passing through the axes C1 and C3 defines, with the axis R, a point of coincidence P1 and the line L2 passing through the axes C2 and C3 defines, with the axis R, a point of coincidence P2. All of the section T3 that extends between the points P1 and P2 corresponds substantially to the length of the central part 26-3 on which the user can act to provoke a selection, that is to say to provoke a change of state and a triggering of the switch 40. The section T1 extending to the left from the point P1 and the section T2 extending to the right from the point P2 correspond to the left 26-1 and right 26-2 axial end parts of the control drum 26 for the complete actuation, with tactile effect, of the detection element on the axis C1, or of the detection element on the axis C2.

Figure 12B:
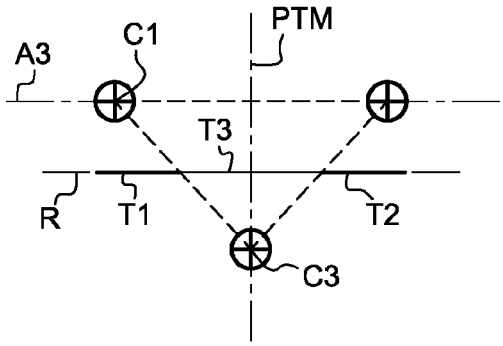

As can be seen in FIG. 12B, a variation of the geometry, that is to say of the various dimensions, and notably the position of the axes C1 and C2 along the axis A3, makes it possible to vary the length of the central section T3. It will be seen here that the design according to the invention makes it possible to reliably actuate the switch 40 without the need for the user to position his or her finger at mid-length, that is to say at the intersection of the axis R and of the PTM plane, as was the case in the prior art.

Figure 10:
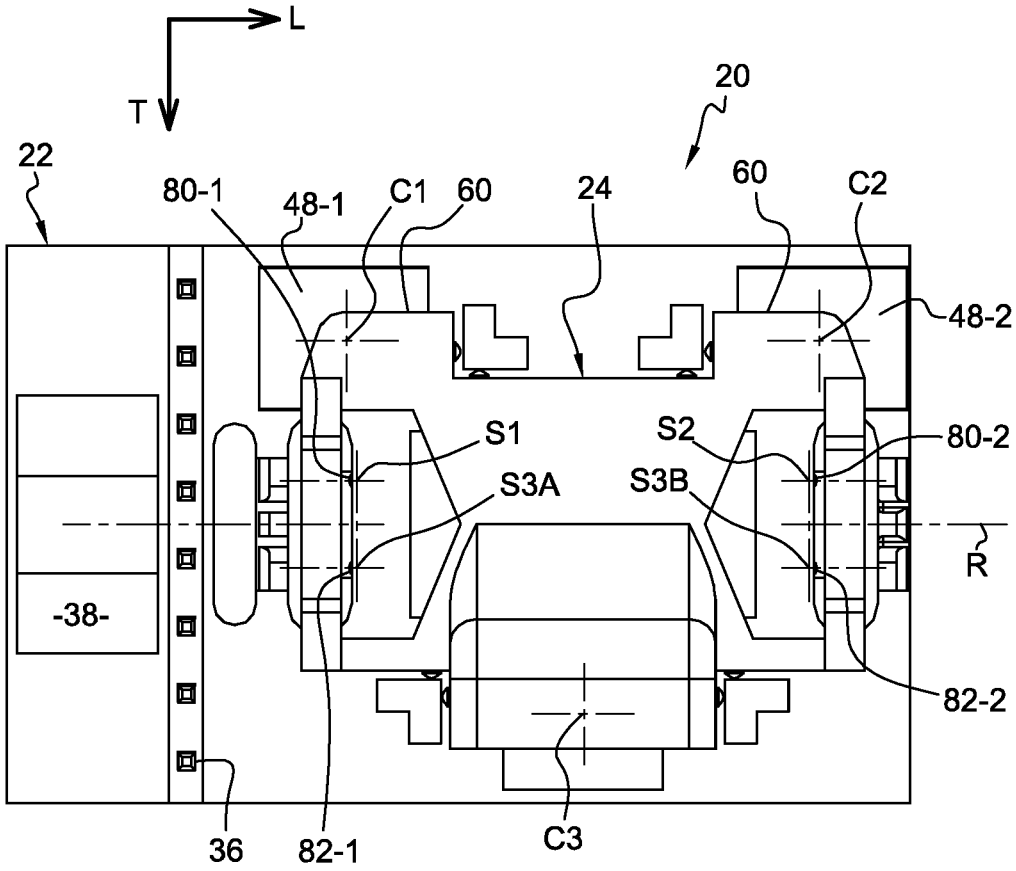
FIG. 10 is a plan view similar to that of FIG. 5, without the control drum and its link shaft.
Figure 11:
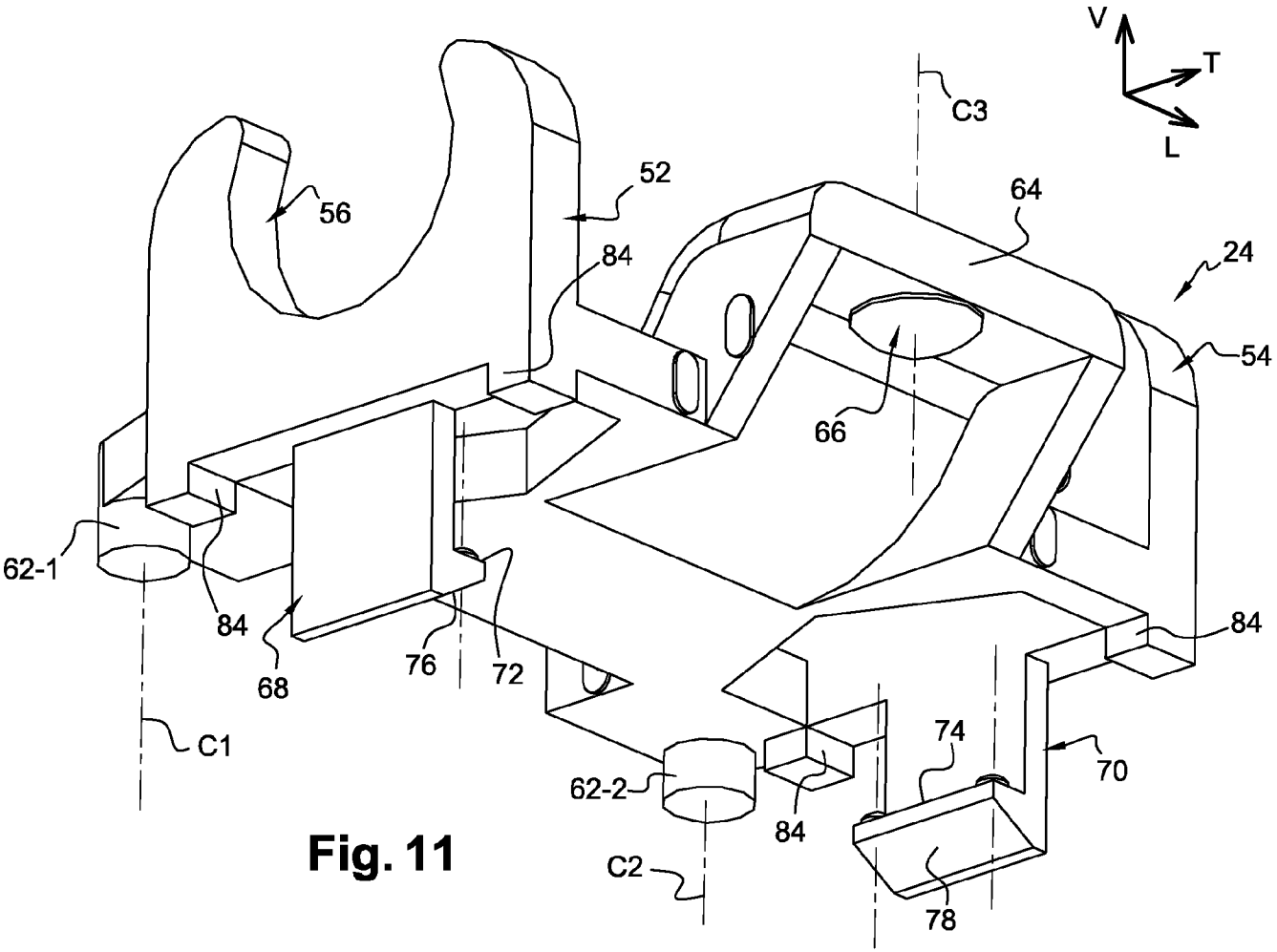
FIG. 11 is a large scale perspective view from below of the intermediate control cradle of the device of FIG. 1.
Figure 13B:
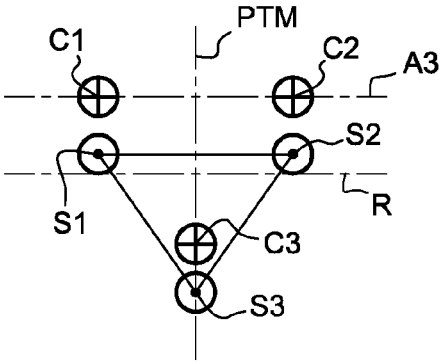
FIG. 13B is a view similar to that of FIG. 13A illustrating a variant design.
Figure 13A:
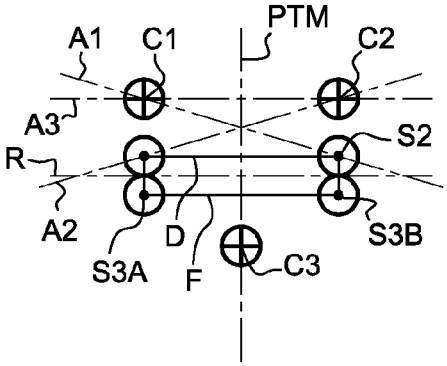
FIG. 13A is a diagram showing in more detail the different arrangements of FIGS. 12A and 12B.

Seen from above, and as can be seen in FIG. 13A, as in FIG. 10, the two pivoting bearing points S1 and S2 are aligned n a straight line D parallel to the axis A3 and to the axis of rotation R. The two bearing points S3A and S3B are bearing points of stability of the intermediate cradle 24 in the inactive high position, the stability here being conferred by the simultaneous bearing of the four bearing points S1, S2, S3A and S3B. The bearing points S3A and S3B, for their part, are aligned on a straight line F parallel to the straight line D, the straight lines D and F being, seen from above, offset transversely on either side of the axis of rotation R. (A variant design has been schematically represented in FIG. 13B, in which a single central bearing point S3 of stability is used that is aligned with the plot of the transversal plane PTM.) When he or she wants to selectively actuate the bistable switch with tactile effect 40, the user presses on the central section T.

This action first provokes the deformation of the two elastically deformable moving contacts 48-1 and 48-2 and therefore a slight vertical travel downwards of the cradle 24 and then, at the end of this deformation, a pivoting about the axis A3 passing through the axes C1 and C2 occurs. Continuing the actuation force by acting on the central section T1 provokes the actuation of the electrical switch 40 with generation of the tactile effect.

Figure 14A:
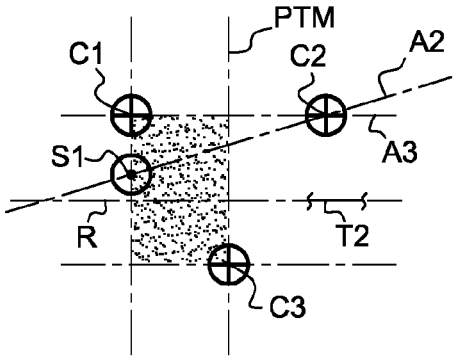
FIG. 14A is a view similar to that of FIG. 13A illustrating in more detail the lateral actuation by acting on the right axial end part of the drum 26.

As is schematically illustrated in FIG. 14A, when the user wants, for example, to selectively actuate the right detection assembly, the user acts on the right end part 26-2, that is to say on the right section T2. A pivoting then occurs, about the pivoting axis A2 that, seen from above, passes through the actuation axis C2 and through the bearing and pivoting point S1, and this occurs without any action on the left detection assembly. The actuation is continued by an action on the switch 40 along the actuation axis C3 to generate the tactile sensation.

The selective actuation of the left detection assembly with generation of a tactile effect is performed symmetrically by acting on the left section T1 and by provoking a pivoting about the pivoting axis A1 that, seen from above, passes through the actuation axis C1 and the right bearing and pivoting point S2. The bearing and pivoting point S1 is situated on the left side relative to the median transversal plane PTM and globally between the axes C1 and C3.

Figure 14B:
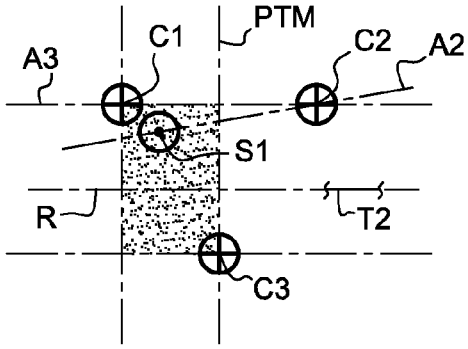
FIG. 14B is a variant of FIG. 14A.

FIG. 14B shows a variant of the positioning of the bearing and pivoting point S1, the latter still being situated in the same shaded area indicated in FIGS. 14A and 14B. The same applies for the symmetrical positioning of the bearing and pivoting point S2. Thus, by virtue of the design according to the invention, there is only a single tactile sensation perceived by the user when he or she acts on one of the three central, left or right parts of the drum 26, and the tactile sensation is generated each time by means of a single component with tactile effect, that is to say here by means of the electrical switch with tactile effect 40.

Thus, again, the design according to the invention by means of a single "switch" with tactile effect and two detection assemblies makes it possible to avoid any risks of doubling (or tripling) the tactile effect while having a central section or part of the drum that has a long axial length to ensure the selection function.

The design is not limited to the various examples and variants which have just been described. For example, the bottom support plate may consist of a part of a printed circuit board.

In order to ensure the balance of the forces and the desired operation, the elastic resistance or elastic stiffness to deformation of the third moving contact element, here incorporated in the electrical switch 40, may be greater than the elastic stiffness of the moving contacts 48-1 and 48-2, this stiffness preferably being greater than the sum of the other two elastic stiffnesses. The elastic return to the inactive high position can be ensured by additional springs which are not represented.

It will be appreciated that various of the above-disclosed and other features and functions, or alternatives thereof, may be desirably combined into many other different systems or applications or combinations of systems and applications. Also that various presently unforeseen or unanticipated alternatives, modifications, variations or improvements therein may be subsequently made by those skilled in the art which are also intended to be encompassed by the following claims.

The invention claimed is:

1. A control device comprising:

a bottom support in the general form of a horizontal plate;

a first, second, and third fixed contacts arranged in a triangle on the top face of the bottom support;

a first, second, and third moving contacts, each of which is elastically deformable and is configured to cooperate with the first, the second, and the third fixed contacts to generate first, second, and third corresponding electrical signals;

an intermediate control cradle, wherein:

the intermediate control cradle is positioned above the fixed bottom support upon which it is movably mounted, the intermediate control cradle comprises a first, second and third actuating pawls, wherein each pawl is configured to act in a pinpoint manner on the first, the second, and the third moving contacts, and the intermediate control cradle is configured to occupy an inactive position, high relative to the bottom support wherein at least one first, one second and one third bearing points of the intermediate control cradle are in abutment, vertically upwards, each against an associated surface portion facing the bottom support, wherein:

the first bearing point is positioned adjacent to a point of action of the first pawl on the first moving contact, the second bearing point is positioned adjacent to a point of action of the second pawl on the second moving contact, and the third bearing point is offset transversely, towards the third moving contact, relative to a line passing through the first and second bearing points; and a cylindrical single top control member that is mounted to rotate in both directions relative to the intermediate cradle about a longitudinal axis of rotation having substantially horizontal orientation, wherein the top control member is configured to rotate a generator of electrical signals representative of the rotation of the control member, and wherein the top control member is configured, by acting via the intermediate cradle, to actuate the first, second, and third moving contacts;

wherein:

the first and the second fixed contacts are aligned longitudinally in a direction that is parallel to the axis of rotation of the control member and is offset transversely on one side of said axis of rotation;

the third fixed contact is offset transversely on the other side of the axis of rotation of the control member; and the intermediate control cradle is mounted to pivot relative to the bottom support about a first pivoting axis passing through the second bearing point and through the point of action of the first pawl on the first moving contact, in order to selectively actuate the first moving contact, upon an action on a first axial end part of the control member, and is further mounted about a second pivoting axis passing through the first bearing point and through the point of action of the second pawl on the second moving contact, in order to selectively actuate the second moving contact, upon an action on the second axial end part of the control member.

2. The control device according to claim 1, where elastic stiffness of the first and second moving contacts is less than that of the third moving contact, and after elastic deformation of the first and second moving contacts, the intermediate control cradle is mounted to pivot relative to the bottom support about a third pivoting axis parallel to the axis of rotation of the control member in order to then actuate the third moving contact upon an action on the central axial part of the control member.

3. The control device according to claim 2, wherein a sum of the elastic stiffnesses of the first and second moving contacts is less than that of the third moving contact.

4. The control device according to claim 2, wherein the third moving contact is a bistable dome-shaped element with tactile effect.

5. The control device according to claim 4, wherein the third fixed contact and the third moving contact are incorporated in a bistable electrical switch with tactile effect which comprises an actuating pushbutton upon which the third pawl of the intermediate control cradle acts.

6. The control device according to claim 1, wherein the intermediate control cradle is returned elastically upwards in said inactive position by said three elastically deformable moving contacts.

7. The control device according to claim 1, wherein the third bearing point of the cradle comprises a pair of third bearing points that are in abutment, vertically upwards, each against an associated surface portion facing the bottom support and which are offset transversely toward the third moving contact relative to a straight line passing through the first and second bearing points.

8. The control device according to claim 1, wherein each bearing point is arranged at a free end of an associated tab which extends vertically downwards from the intermediate cradle.

9. The control device according to claim 1, wherein the control device comprises a general design symmetry relative to a vertical and transversal plane of symmetry orthogonal to the axis of rotation of the control member and passing through the point of the third pawl which acts on the third moving contact.

* * * * *